US005778686A

United States Patent [19]

Choi

[11] Patent Number: 5,778,686

[45] Date of Patent: Jul. 14, 1998

[54] METHOD OF CONTROLLING AN OPERATION OF AN AUTOMATIC ICE MAKER IN A REFRIGERATOR

[75] Inventor: Byung-Joon Choi, Incheon, Rep. of Korea

[73] Assignee: Daewoo Electronics Co., Ltd., Rep. of Korea

[21] Appl. No.: 866,084

[22] Filed: May 30, 1997

[30] Foreign Application Priority Data

Sep. 25, 1996 [KR] Rep. of Korea ..... 96-42576

[51] Int. Cl.[6] ..... F25C 1/10

[52] U.S. Cl. ..... 62/71; 62/135; 62/208

[58] Field of Search ..... 62/71, 72, 135, 62/208, 353

[56] References Cited

U.S. PATENT DOCUMENTS

| | | | |
|---|---|---|---|
| 3,071,933 | 1/1963 | Shoemaker | 62/71 |
| 4,909,039 | 3/1990 | Yamada et al. | 62/66 |
| 5,027,610 | 7/1991 | Hara | 62/135 |
| 5,163,300 | 11/1992 | Kato et al. | 62/71 |
| 5,182,916 | 2/1993 | Oike et al. | 62/135 |

*Primary Examiner*—William E. Tapolcai

*Attorney, Agent, or Firm*—Cushman Darby & Cushman Intellectual Property Group of Pillsbury Madison & Sutro, LLP

[57] ABSTRACT

Disclosed is a method of controlling an operation for determining an optimum ice removing period based on the present temperature in a freezing compartment and the present temperature in an ice making compartment in an automatic ice maker of a refrigerator. A controlling section measures a first present temperature of an ice tray through an ice making sensor installed at a portion of the ice tray and compares the first present temperature with a first reference temperature. If the first present temperature is the same as or higher than the first reference temperature, the controlling section compares an accumulated value of time computed based on a weight value established according to a range of the present temperature of the freezing compartment with a reference time. If the accumulated value is the same as or larger than the reference time, the controlling section compares a second present temperature of the ice tray, measured through the ice making sensor, with a second reference temperature and carries out an ice removing operation. Therefore, the efficiency of the ice making can be maximized through a reduction in the ice making time. Further, the electric power consumed by the ice maker or the refrigerator can be reduced.

13 Claims, 4 Drawing Sheets

METHOD OF CONTROLLING AN OPERATION OF AN AUTOMATIC ICE MAKER IN A REFRIGERATOR

BACKGROUND OF THE INVENTION

1. Field of the Invention

The present invention relates to a method of controlling an operation in an automatic ice maker of a refrigerator which accomplishes the optimization of the effect of an ice making by an optimized determination of the period of an ice removing based on the present temperature of an ice making compartment and a freezing compartment.

2. Description of the Prior Art

Recently, a large-sized refrigerator has an automatic ice maker in correspondence with the need of users and with the increase in demand. FIG. 1 is an exploded view for showing an embodiment of the mechanical structure of the conventional automatic ice maker. As shown in FIG. 1, an automatic ice maker 10 includes front and rear cases 11 and 12, an ice making motor 13, a gear cam 14 and a gear plate 15. Automatic ice maker 10 further includes horizontal and ice full micro switches 16 and 17 which are installed on gear plate 15, an auxiliary plate 18 and an ice tray 19. A water supplying tank (not shown) for supplying water to ice tray 19 is connected with automatic ice maker 10. Ice which is produced in ice tray 19 is stored in an ice storing container.

An apparatus for controlling the ice making operation of automatic ice maker 10 controls the water supplying tank for supplying a predetermined amount of water at each time, from the water supplying tank to the ice tray. The ice which is produced in the ice tray is piled up in the ice storing container by the controlling operation of the controlling apparatus.

In the apparatus for controlling the ice making operation, a sensor or a timer for determining the operating time of the water supply of the water supplying pump, a temperature sensor for sensing the completion of the ice making, an ice making motor for carrying out the ice removing operation by rotating the ice tray, etc. are provided. The elements are included to give an organic operation.

That is when the temperature sensor senses the completion of the ice making, the ice making motor rotates the ice tray through a velocity-reduction gear which is connected to the ice making motor. When the rotating angle of the ice tray becomes a predetermined angle, the ice tray is caught in a bracket and twisted to separate the produced ice from the ice tray. The separated ice falls into the ice storing container.

Next, the ice tray continues the rotation for a predetermined time and returns to the original position through a rotation in the opposite direction. That is, the automatic ice maker prepares the next ice making process.

Hereafter, the ice making process will be described with reference to FIG. 1.

When an operating power source is supplied to automatic ice maker 10, an initial controlling operation for keeping ice making vessel 19 horizontal, is carried out. The initial controlling operation is controlled by horizontal micro switch 16 for rotating ice removing motor 13 clockwise or counterclockwise. The apparatus for controlling the ice making firstly carries out the ice removing operation of the produced ice in ice making vessel 19 through the ice making process instead of supplying water into ice making vessel 19. Next, the apparatus for controlling the ice making controls the power source portion (not shown) to supply the operating power source to the water supplying motor (not shown). Accordingly, the water supplying operation commences. The firstly performed ice removing operation prevents the error of the apparatus for controlling the ice making by judging a normal supplying state of ice making vessel 10 and carrying out the next ice making operation even when ice making vessel 10 is not normally supplied.

After the completion of the water supplying operation and after a predetermined time (for example, for 2.4 hours), the apparatus for controlling the ice making measures the present temperature of the ice tray through an ice making sensor (that is, I sensor, see FIG. 2) installed on a portion of ice tray 19. When the temperature is not above a reference temperature (that is, 12.5° C.), the apparatus for controlling the ice making judges that the ice making operation is contemplated.

After the completion of the ice making operation, the apparatus for controlling the ice making rotates ice removing motor 13 to rotate ice tray 19 through gear cam 14. When ice tray rotates, the twist of a case by auxiliary plate 18 is generated. After the completion of the ice removing operation, ice removing motor rotates in the opposite direction and the horizontal state of ice tray 19 is controlled by horizontal micro switch 16.

After that, the apparatus for controlling the ice making judges if an ice full state is obtained through ice full micro switch 17. If an 'on' contacting signal is provided from ice full micro switch 17, the apparatus for controlling the ice making judges that the present state is not the ice fulling state and makes the water supplying operation for a continuous ice making to be executed. If an 'off' contacting signal is provided from ice full micro switch 17, the apparatus for controlling the ice making judges this condition as an ice fulling state and makes both the waiting operation of the water supply and the stop operation of the ice making to be executed.

After completion of the ice removing operation and when the storing amount of the ice is insufficient, the apparatus for controlling the ice making controls the power source portion (not shown) to provide the operating power source to the water supplying motor for a predetermined time. During the water supplying operation, if the apparatus for controlling the ice making judges the presence of water in the water supplying tank through a water supplying sensor, the water supplying operation is carried out again after 30 minutes. If the apparatus for controlling the ice making judges the absence of water in the water supplying tank, the ice making operation is considered to be complete and the subsequent operation is carried out.

U.S. Pat. No. 4,909,039 (granted to Koji Yamada et al.) discloses a method for detecting a water unsupplied condition when water has not been supplied to an ice tray even though the water supply operation is executed by a water supply section in a refrigerator. The method for detecting the water unsupplied condition of the ice tray of the refrigerator includes measuring the temperature of the ice tray after the water supply operation of the water supply section to the ice tray is executed and determining that the water has not been supplied to the ice tray, where the measured temperature is below a predetermined reference value. The ice maker of the refrigerator includes an ice tray which is supplied with water, which is refrigerated by an evaporator so that ice is made, an ice removing section for removing ice from the ice tray, a water supply section for supplying water to the ice tray every time the ice is removed from the ice tray, a temperature sensor for sensing the temperature of the ice tray, and a determination circuit section for comparing the temperature of the ice tray sensed by the temperature sensor with the predetermined reference value and determining that the water has not been supplied to the ice tray. Here, the temperature of the ice tray sensed by the temperature sensor is below the predetermined reference value.

In the automatic ice maker of the refrigerator, which carries the ice making operation according to the controlling operation of the above described apparatus for controlling the ice making, since the period of performing the ice removing operation is set to a fixed value (for example, for 2.4 hours), the ice making process is inefficient. Accordingly, the electric power consumed is increased.

SUMMARY OF THE INVENTION

Accordingly, it is an object of the present invention to provide a method of controlling an operation in an automatic ice maker installed in the freezing compartment of a refrigerator, which determines an optimized ice removing period based on the temperature in the freezing compartment and the temperature of an ice tray.

Another object of the present invention is to provide a method of controlling an operation of an automatic ice maker according to the ice removing period.

To accomplish the objects of the present invention, there is provided a method of controlling an operation of an automatic ice maker in a refrigerator comprising the steps of:

(a) measuring a first present temperature of an ice tray through an ice making sensor installed in a portion of the ice tray and comparing the first present temperature with a first reference temperature;

(b) comparing an accumulated value of a time computed on the basis of a weight value established by a range of a present temperature of a freezing compartment, measured through a freezing sensor installed in the freezing compartment, with a reference time when step (a) judges that the first present temperature is the same as or higher than the first reference temperature; and (c) carrying out an ice removing operation after comparing a second present temperature of the ice tray, measured through the ice making sensor, with a second reference temperature when step (b) judges that the accumulated value is the same as or greater than the reference time.

In the method of controlling the operation of the automatic ice maker in the refrigerator according to the present invention, an ice removing period which has been commonly fixed is determined to an optimized value based on the present temperature of the freezing compartment and the temperature of the ice tray, and the operation of the automatic ice maker is controlled according to the ice removing period. Accordingly, maximization of the efficiency of the ice making can be accomplished by a reduction in the ice making time. In addition, the electric power consumed by the refrigerator or the ice maker can be reduced.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Hereinafter, the constituting elements and the operating principles of the automatic ice maker of the refrigerator according to the present invention will be explained in more detail with reference to the accompanying drawings.

Figure 1:
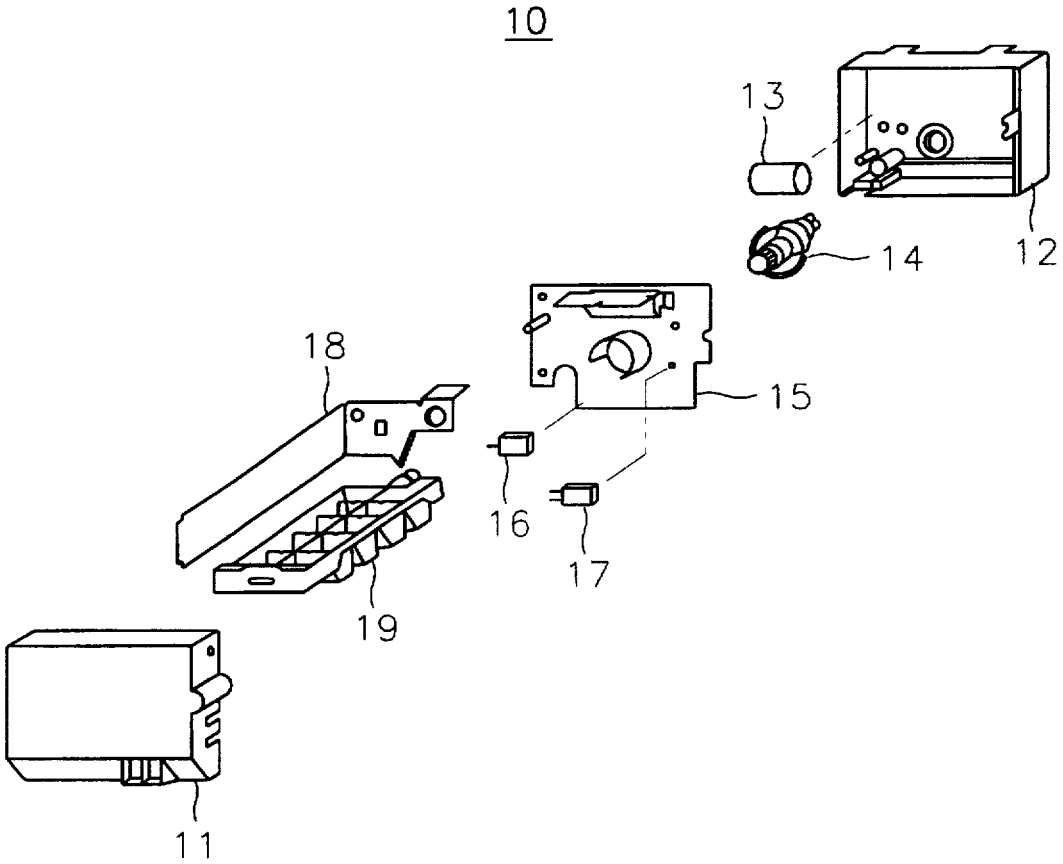
FIG. 1 (PRIOR ART)
FIG. 1 is an exploded view for showing an embodiment of the mechanical structure of the conventional automatic ice maker.
Figure 2:
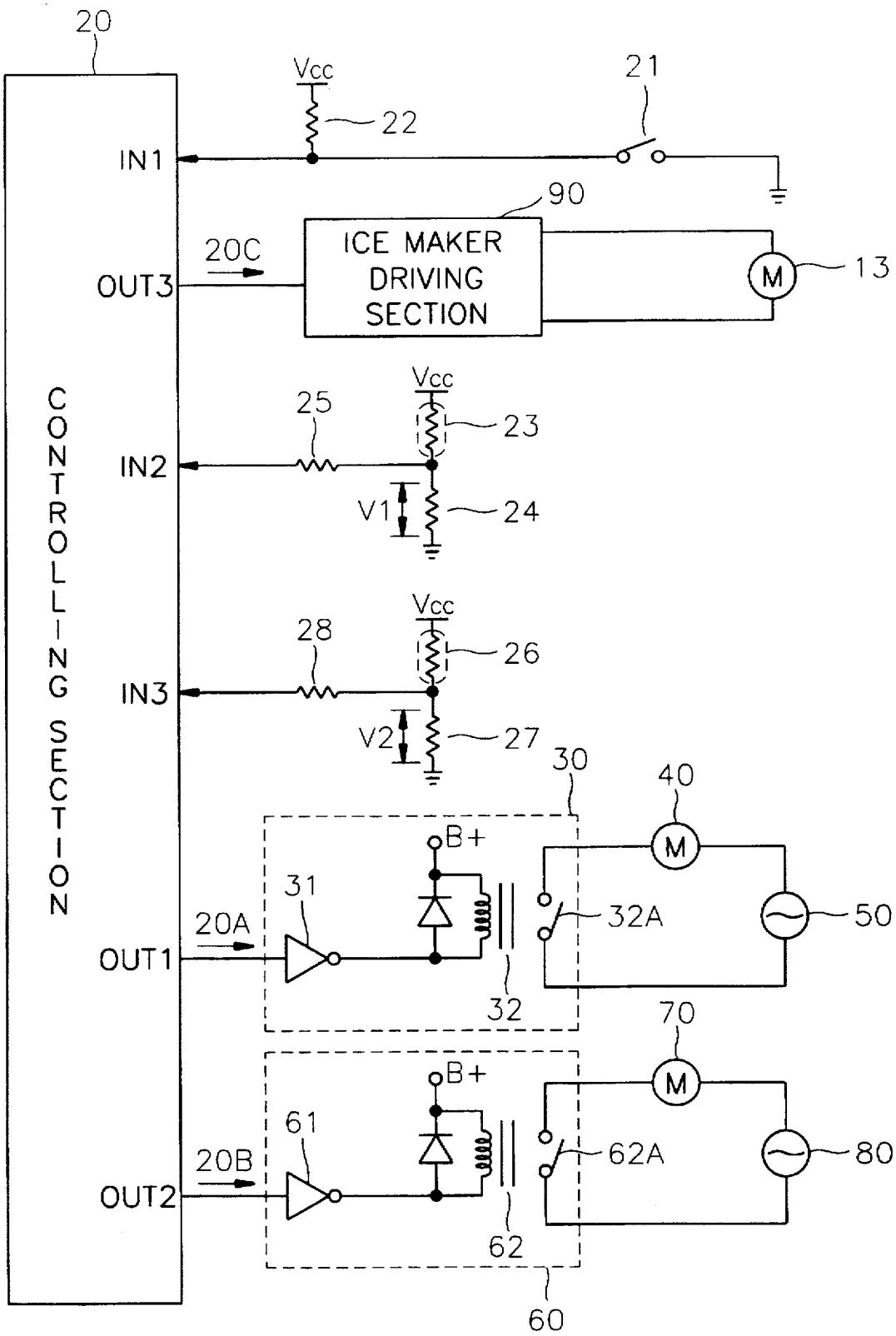
FIG. 2 is a circuit block diagram for showing the constitution of the controlling apparatus of a refrigerator having an apparatus for controlling an ice making according to the present invention.

FIG. 2 is a circuit block diagram for showing the constitution of the controlling apparatus of a refrigerator having an apparatus for controlling an ice making according to the present invention. In FIG. 2, the apparatus for controlling the ice making includes a controlling section 20, a freezing sensor 23, a first reference resistance 24, a second current limiting resistance 25, an ice making sensor 26, a second reference resistance 27, a third current limiting resistance 28 and a driving section of an ice maker 90.

As shown in FIG. 2 when a door switch 21 is in an 'on' state, controlling section 20 is connected with door switch 21 and with first current limiting resistance 22 to apply Vcc voltage through current limiting resistance 22 (i.e. logical voltage signal of 'high' level) into a first input terminal IN1 of controlling section 20. And when door switch 21 is in an 'off' state, controlling section 20 is connected with door switch 21 to apply the logical voltage signal of low level to first input terminal IN1.

Freezing sensor 23 (i.e. F sensor) is installed in a freezing compartment and detects the present temperature in the freezing compartment as a first resistance value. Controlling section 20 is connected with freezing sensor 23 so that the first resistance value detected by freezing sensor 23 is transformed into a first voltage V1 by first reference resistance 24 and Vcc voltage, and first voltage V1 is applied to a second input terminal IN2 through second current limiting resistance 25.

Ice making sensor 26 (i.e. I sensor) is installed at a portion of an ice tray 19 and detects the present temperature of ice tray 19 or of an ice making compartment as a second resistance value which is proportional to the present temperature. Controlling section 20 is connected with ice making sensor 26 so that the second resistance value detected by ice making sensor 26 is transformed into a second voltage V2 by second reference resistance 27 and Vcc voltage, and second voltage V2 is applied to a third input terminal IN3 through third current limiting resistance 28.

A driving section of a compressor 30 drives a compressor 40 and includes a first inverter 31 and a first relay 32. A first contact 32A included in first relay 32 is connected with compressor 40 and with a first alternating current power 50 so that first alternating current power 50 supplies or doesn't supply an electric power to compressor 40 according to the switching operation of first contact 32A.

A driving section of a cooling fan 60 drives a cooling fan 70 and includes a second inverter 61 and a second relay 62. A second contact 62A included in second relay 62 is connected with cooling fan 70 and with a second alternating current power 80 so that second alternating current power 80 supplies or doesn't supply an electric power to cooling fan 70 according to the switching operation of second contact 62A.

Controlling section 20 provides first and second controlling signals 20A and 20B through first and second output terminals OUT1 and OUT2, respectively. Controlling section 20 is connected with compressor driving section 30 and with cooling fan driving section 40 so that first and second controlling signals 20A and 20B are respectively applied to compressor driving section 30 and cooling fan driving section 60.

Controlling section 20 provides a third controlling signal 20C through a third output terminal OUT3. Controlling section 20 is connected with ice maker driving section 90 so that third controlling signal 20C is applied to ice maker driving section 90. Third controlling signal 20C rotates an ice removing motor 13 clockwise or counterclockwise.

The controlling process of the operation of the automatic ice maker by the controlling apparatus of the refrigerator having the apparatus for controlling the ice making including the above described constitution, will be described with reference to the flow chart in FIGS. 3 and 4.

Figure 3:
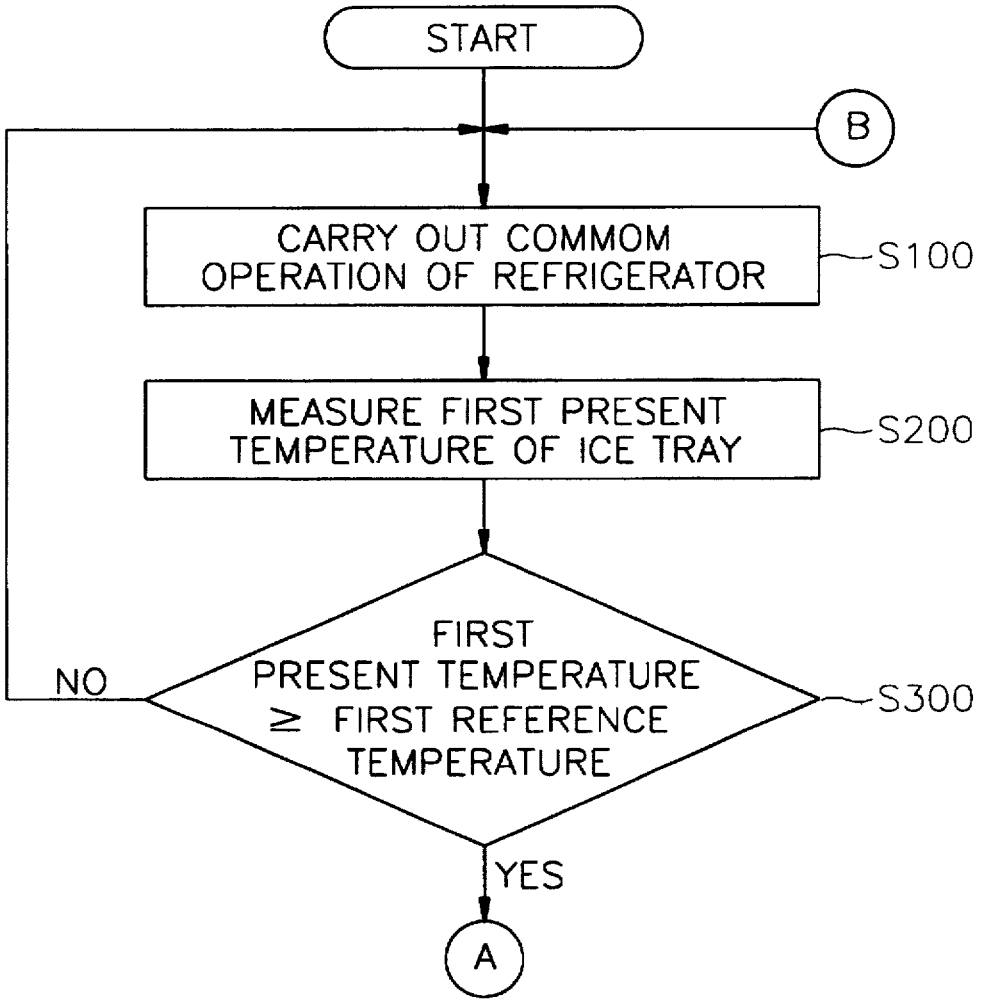
FIGS. 3 and 4 are a flow chart for illustrating a method of carrying out the ice removing operation of an automatic ice maker based on the present temperature in a freezing compartment and the present temperature of an ice making compartment by the apparatus for controlling the ice making shown in FIG. 2.
Figure 4:
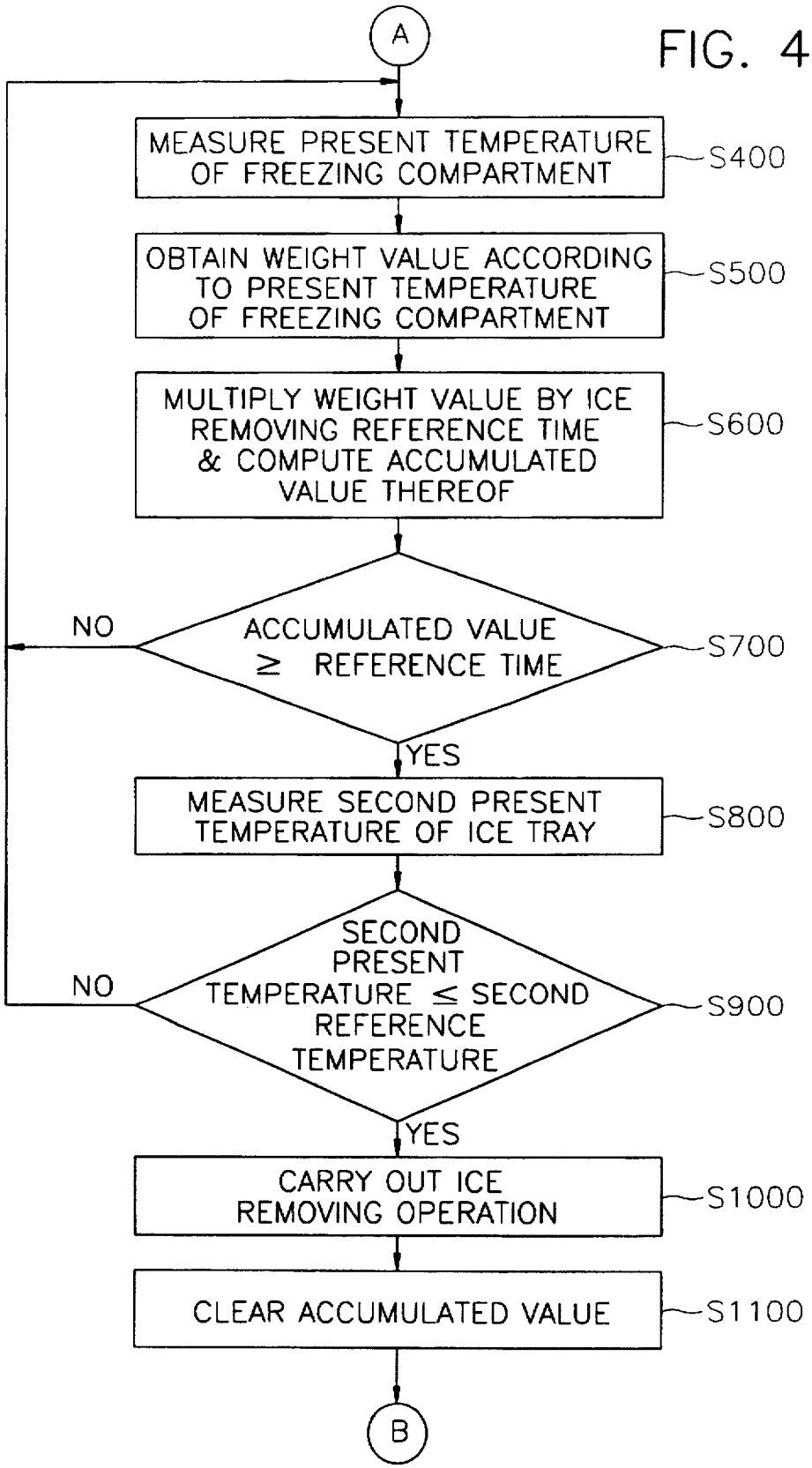

FIGS. 3 and 4 are a flow chart for illustrating a method of carrying out the ice removing operation of the automatic ice maker based on the present temperature in the freezing compartment and the present temperature of the ice making compartment by the apparatus for controlling the ice making shown in FIG. 2.

When an operating power is supplied to the refrigerator, controlling section 20 supplies first and second controlling signals 20A and 20B through first and second output terminals OUT1 and OUT2, respectively, to compressor driving section 30 and cooling fan driving section 60. And first and second alternating current power 50 and 80 respectively provide operating powers to compressor 40 and cooling fan 70.

That is, first controlling signal 20A is high level and is inverted while passing through first inverter 31 to drive first relay 32. The operating power is provided to compressor 40 by the 'on' state of first contact 32A of first relay 32 to operate compressor 40. Second controlling signal 20B is high level and is inverted while passing through second inverter 61 to drive second relay 62. The operating power is provided to cooling fan 70 by the 'on' state of second contact 62A of second relay 62 to drive cooling fan 70. Accordingly, the cooling operation of the refrigerator commences.

After that when the temperature in the refrigerator reaches a predetermined value, controlling section 20 reads the present temperature data of the freezing compartment and a chilled compartment through freezing sensor 23 and a chilled sensor (not shown in FIG. 2) installed in the chilled compartment, and reads open/close data of a door through door switch 21. Accordingly, controlling section 20 carries out the controlling operation based on the various data to maintain the optimum temperature in the refrigerator (step S100).

During carrying out of the routine operations of the refrigerator, when the operating signal of the automatic ice maker is generated, controlling section 20 measures a first present temperature of ice tray 19 through ice making sensor 26 (step S200). That is, the first present temperature of ice tray 19 or ice making compartment is detected by ice making sensor 26 as the second resistance value which is proportional to the first present temperature. The second resistance value is transformed into second voltage V2 by second reference resistance 27 and Vcc voltage, and the second voltage V2 is inputted into third input terminal IN3 of controlling section 20 through third current limiting resistance 28.

Controlling section 20 compares the first present temperature which is measured in step S200 with the first reference temperature (step S300). If the first present temperature is lower than the first reference temperature, the common operation of the refrigerator is continued from step S100 by controlling section 20.

If the first present temperature is judged as lower than the predetermined first reference temperature to step S300, controlling section 20 reads the information on the present temperature of the freezing compartment, which is inputted through second input terminal IN2, and judges the present temperature of the freezing compartment (step 400). That is, the present temperature of the freezing compartment is detected by freezing sensor 23 as the first resistance value which is proportional to the present temperature of the freezing compartment. The first resistance value is transformed into first voltage V1 by first reference resistance 24 and Vcc voltage, and first voltage V1 is inputted into second input terminal IN2 of controlling section 20 through second current limiting resistance 25.

TABLE 1

| | No. | | | |
|---|---|---|---|---|
| | 1 | 2 | 3 | 4 |
| present temperature of freezing compartment | −20° C. and below | −20° C.−−18° C. | −18° C.−−15° C. | −15° C. and over |
| weight value | 1.5 | 1.3 | 1.1 | 0.9 |
| reference time | 2.4 hrs | 2.4 hrs | 2.4 hrs | 2.4 hrs |
| second reference temperature | −12.5° C. | −12.5° C. | −12.5° C. | −12.5° C. |

When the present temperature of the freezing compartment is known, controlling section 20 fetches a corresponding weight value according to the present temperature of the freezing compartment with reference to the table of the weight value shown in Table 1, as one example (step S500). That is when the present temperature of the freezing compartment read out by controlling section 20 is −20° C. and below, the corresponding weight value is 1.5.

Controlling section 20 computes a time by multiplying the weight value of 1.5 by the predetermined ice removing reference time, and judges if the computed time reaches the reference time (i.e. 2.4 hours) (step S600 and S700). If the computed time is shorter than the reference time, the procedure returns to step S400 by controlling section 20 and the present temperature of the freezing compartment is measured again. Accordingly, controlling section 20 fetches the weight value again with reference to the table of the weight value and computes the time by multiplying the weight value by the predetermined ice removing reference time. At this time, controlling section 20 computes an accumulated value of the computed time (step 600) and judges if the accumulated value reaches the reference time (i.e. 2.4 hours) (step 700).

If the accumulated value is the same as or larger than the reference time in step S700, controlling section 20 measures a second present temperature of ice tray 19 or the ice making compartment through ice making sensor 26. That is, the second present temperature of ice tray 19 or the ice making compartment is detected by ice making sensor 26 as the second resistance value which is proportional to the second present temperature. The second resistance value is transformed into second voltage V2 by second reference resistance 27 and Vcc voltage, and second voltage V2 is inputted into third input terminal IN3 of controlling section 20 through third current limiting resistance 28.

If the second present temperature is higher than the second reference temperature, the procedure returns to step S400 by controlling section 20 and the present temperature of the freezing compartment is measured again.

If the second present temperature is higher than the second reference temperature in step S900, controlling section 20 commences the ice removing operation at step S1000. At this time, controlling section 20 applies third controlling signal 20C through third output terminal OUT3 for rotating ice removing motor 13 of ice maker driving section 90 clockwise or counterclockwise.

That is, since both the present temperature of the freezing compartment and the present temperature of ice tray 19 satisfy the condition of the ice removing as described above, the removing operation of the automatic ice maker is carried out even though the ice making time does not reach the conventional ice making time (i.e. 2.4 hours).

In step S1100, controlling section 20 clears the accumulated value recorded in a memory in relation with the ice making operation. After that, the process returns to step S100 by controlling section 20 for preparing the next ice making process of the refrigerator.

In the method of controlling the operation of the automatic ice maker in the refrigerator according to the present invention, the conventionally fixed ice removing period is optimized based on the present temperature in the freezing compartment and the temperature of the ice tray. The operation of the automatic ice maker is controlled by the ice removing period. Accordingly, the efficiency of the ice making is maximized through a reduction in the ice making time. Further, the electric power consumed by the ice maker or the refrigerator can be reduced.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. A method of controlling an operation of an automatic ice maker in a refrigerator, said method comprising the steps of:

(a) measuring a first present temperature of an ice tray through an ice making sensor installed in a portion of said ice tray and comparing the first present temperature with a first reference temperature;

(b) comparing an accumulated value of a time computed on the basis of a weight value established by a range of a present temperature of a freezing compartment, measured through a freezing sensor installed in said freezing compartment, with a reference time when step (a) judges that the first present temperature is the same as or higher than the first reference temperature; and (c) carrying out an ice removing operation after comparing a second present temperature of said ice tray, measured through said ice making sensor, with a second reference temperature when step (b) judges that the accumulated value is the same as or greater than the reference time.

2. The method of controlling an operation of an automatic ice maker in a refrigerator as claimed in claim 1, wherein said step (a) comprises the substeps of:

(i) carrying out a common operation of said refrigerator;

(ii) measuring the first present temperature of said ice tray through said ice making sensor when an operating signal is generated with respect to said automatic ice maker while carrying out step (i); and (iii) comparing the first present temperature measured in step (ii) with the first reference temperature.

3. The method of controlling an operation of an automatic ice maker in a refrigerator as claimed in claim 2, wherein said step (iii) returns to step (i) when step (iii) judges that the first present temperature is lower than the first reference temperature.

4. The method of controlling an operation of an automatic ice maker in a refrigerator as claimed in claim 1, wherein said step (b) comprises the substeps of:

(iv) measuring the present temperature of said freezing compartment through said freezing sensor when step (a) judges that the first present temperature is the same as or higher than the first reference temperature;

(v) obtaining the weight value differently established according to the range of the present temperature of said freezing compartment, measured in step (iv);

(vi) computing the time by multiplying the weight value obtained in step (v) by an ice removing reference time and computing an accumulated value by accumulating the computed time; and (vii) comparing the accumulated value in step (vi) with the reference time.

5. The method of controlling an operation of an automatic ice maker in a refrigerator as claimed in claim 4, wherein said step (vii) returns to step (iv) when step (vii) judges that the accumulated value is smaller than the reference time.

6. The method of controlling an operation of an automatic ice maker in a refrigerator as claimed in claim 1, wherein said step (c) comprises the substeps of:

(viii) measuring the second present temperature of said ice tray through said ice making sensor when step (h) judges that the accumulated value is the same as or larger than the reference time;

(ix) comparing the second present temperature measured in step (viii) with the second reference temperature;

(x) carrying out the ice removing operation when step (ix) judges that the second present temperature is the same as or lower than the second reference temperature; and (xi) clearing the accumulated value recorded in a memory in relation with an ice making operation.

7. The method of controlling an operation of an automatic ice maker in a refrigerator as claimed in claim 6, wherein said step (ix) returns to step (iv) in step (b) when step (ix) judges that the second present temperature is higher than the second reference temperature.

8. The method of controlling an operation of an automatic ice maker in a refrigerator as claimed in claim 1, further comprising the substep of returning to step (a) after carrying out step (c) and carrying out a next ice making operation.

9. A method of controlling an operation of an automatic ice maker in a refrigerator, said method comprising the steps of:

(i) carrying out a common operation of a refrigerator;

(ii) measuring a first present temperature of an ice tray through an ice making sensor when an operating signal is generated with respect to said automatic ice maker while carrying out step (i);

(iii) comparing the first present temperature measured in step (ii) with a first reference temperature;

(iv) measuring a present temperature of a freezing compartment through a freezing sensor when step (iii) judges that the first present temperature is the same as or higher than said first reference temperature;

(v) obtaining a weight value differently established according to a range of the present temperature of said freezing compartment, measured in step (iv);

(vi) computing a time by multiplying the weight value obtained in step (v) by an ice removing reference time and computing an accumulated value by accumulating the computed time;

(vii) comparing the accumulated value computed in step (vi) with a reference time;

(viii) measuring a second present temperature of said ice tray through said ice making sensor when step (vii) judges that the accumulated value is the same as or larger than the reference time;

(ix) comparing the second present temperature measured in step (viii) with a second reference temperature;

(x) carrying out an ice removing operation when step (ix) judges that the second present temperature is the same as or lower than the second reference temperature; and (xi) clearing the accumulated value recorded in a memory in relation with an ice making operation.

10. The method of controlling an operation of an automatic ice maker in a refrigerator as claimed in claim 9, wherein said step (iii) returns to step (i) when step (iii) judges that the first present temperature is lower than the first reference temperature.

11. The method of controlling an operation of an automatic ice maker in a refrigerator as claimed in claim 9, wherein said step (vii) returns to step (iv) when step (vii) judges that the accumulated value is smaller than the reference time.

12. The method of controlling an operation of an automatic ice maker in a refrigerator as claimed in claim 9, wherein said step (ix) returns to step (iv) when step (ix) judges that the second present temperature is higher than the second reference temperature.

13. The method of controlling an operation of an automatic ice maker in a refrigerator as claimed in claim 9, further comprising the substep of returning to step (i) after carrying out step (xi) and carrying out a next ice making operation.

* * * * *